US005154388A

United States Patent [19]

Magaro

[11] Patent Number: 5,154,388

[45] Date of Patent: Oct. 13, 1992

[54] UNIVERSAL SHELF BRACKET, SHELVING SYSTEM USING SUCH BRACKET, AND METHOD OF BUILDING SUCH A SHELVING SYSTEM

[75] Inventor: Frank M. Magaro, Williamsport, Pa.

[73] Assignee: C. A. Reed Incorporated, Williamsport, Pa.

[21] Appl. No.: 705,544

[22] Filed: May 24, 1991

Related U.S. Application Data

[63] Continuation-in-part of Ser. No. 362,100, Jun. 6, 1989, abandoned.

[51] Int. Cl.[5] ..... A47G 29/02

[52] U.S. Cl. ..... 248/248; 108/108; 211/193; 248/222.2

[58] Field of Search ..... 248/248, 247, 243, 235, 248/220.3, 222.2, 224.4, 242; 211/135, 190, 192, 193, 187, 153; 108/106, 107, 108, 110, 96, 98

[56] References Cited

U.S. PATENT DOCUMENTS

| | | | |
|---|---|---|---|
| D. 295,950 | 5/1988 | Johnston | 108/108 |
| 2,477,735 | 8/1949 | Gentile | 248/243 |
| 3,207,100 | 9/1965 | Peacock | 248/248 |
| 3,468,507 | 9/1969 | Gerdman | 248/243 |
| 3,510,010 | 5/1970 | Gasher | 248/248 |
| 3,537,671 | 11/1970 | Wenthe | 248/247 |
| 3,572,626 | 3/1971 | Bertschi | 248/243 |
| 3,628,762 | 12/1971 | Williams | 248/222.2 |
| 4,198,913 | 4/1980 | Haworth | 248/243 |
| 4,378,925 | 4/1983 | Griffin | 248/248 |
| 4,575,164 | 3/1986 | Pinnow | 248/243 |

FOREIGN PATENT DOCUMENTS

| | | | |
|---|---|---|---|
| 120510 | 3/1901 | Fed. Rep. of Germany | 248/243 |
| 609885 | 10/1948 | United Kingdom | 211/153 |

*Primary Examiner*—J. Franklin Foss

*Attorney, Agent, or Firm*—Antonelli, Terry, Stout & Kraus

[57] ABSTRACT

Disclosed is a bracket or adapter for a shelving system using slotted mounting supports, in which the bracket has a single tab to provide a universal fit; a shelving system using such bracket; and a method for creating a shelving system with such a bracket to eliminate the need for inventorying a wide variety of brackets to fit the mounting supports of different manufacturers. The bracket has a notch between a main body of the bracket and the tab, with the lower end of a slot to be accommodated in the notch, the tab being passed into the slot. The tab has a supporting surface to provide against an inside face of the mounting support over a wide variety of slot sizes, and the main body has an elongated rearwardly facing surface to abut against an outside face of the mounting support. The tab is configured to facilitate insertion into slots of various lengths and various depths. A flange on the bracket is provided with elongated slots to compensaate for different shelving lengths. The notch has side walls that diverge from each other in a direction from the base of the notch to the opening into the notch, so that an increased range of wall thickness can be accommodated in the notch.

29 Claims, 2 Drawing Sheets

UNIVERSAL SHELF BRACKET, SHELVING SYSTEM USING SUCH BRACKET, AND METHOD OF BUILDING SUCH A SHELVING SYSTEM

This application is a continuation in part application of application Ser. No. 07/362,100, filed Jun. 6, 1989, the contents of Ser. No. 07/362,100, filed Jun. 6, 1989, being incorporated herein by reference in their entirety, now abandoned.

BACKGROUND OF THE INVENTION

The present invention relates to a member, such as a bracket for supporting, e.g., a shelf, the member to be mounted on a slotted support member (e.g., a slotted support member positioned vertically). Illustratively, the present invention is directed to a shelving system adapter or bracket and, more particularly, to a shelf bracket or adapter that permits different types of shelving to be used with a wide variety of presently available fixturing systems where the maximum slot length is about $1\frac{1}{8}$ inches, and a method of building a shelving system utilizing such a bracket.

The display industry utilizes a considerable amount of display hardware and accessories in order to display items for viewing in a manner which is both appealing and accessible to the person for whom a particular display is targeted. However, there is a wide variety of hardware available on the market, and most of this hardware is not interchangeable. For example, one line of display hardware includes slotted and unslotted tubing or standards and various types of shelving brackets which are indicated to fit "universal" slotting, i.e., $\frac{1}{2}$ inch, $\frac{3}{8}$ inch slots on 1 inch centers. However, the problem with all such hardware is that it is not truly universal inasmuch as it cannot be used interchangeably with the hardware of other manufacturers who use different size slots on different centers with tubing o standards with different wall thicknesses. Consequently, the display industry is compelled to inventory a variety of hardware so as to be able to utilize existing shelving systems available in stores. This results in considerable inconvenience and high inventory costs. The nature of the problem is shown by some conventional brackets using multiple tabs varying in size and shape as shown in FIGS. 4A through 4E. Due to the spacing between the multiple tabs, these brackets are inherently limited to particular slot sizes and spacings.

Display units using various bracket designs with a single tab for shelving have also long been well known. For instance, German Patent 120510 shows a shelving adapter constructed to hold shelving orthogonal to a slotted standard or pole. The adapter uses a curved ear which is inserted into a desired pole slot such that a bottom vertical surface intersecting a bottom end of the curved surface of the ear at a pivot point abuts an outside wall of the standard or pole and a top vertical surface intersecting the upper end of the curved surface of the ear abuts a inside wall of the standard when the adapter is in place. However, the vertical distance between the top of the bottom vertical surface and the bottom of the top vertical surface is substantially the same as the length of the standard slots. Moreover, the bottom vertical surface is relatively short and does not provide substantial rigidity and strength for shelving supported thereon. Although the curved surface may be useful in permitting the insertion of the adapter due to the snug fit between the adapter and the slot, the adapter is not designed to provide universal use on other types of standards where, for example, the slot is substantially larger than the aforementioned vertical distance and the top vertical surface on the adapter.

Another type of bracket and vertical support is shown in U.S. Pat. No. 2,477,735. In this known arrangement, the bracket is formed of a flat piece of sheet metal and has a head portion with a short ear which is passed through a slot in the support. The ear has a short upper vertical surface to abut the interior of the support wall above the upper terminal of the slot and a notch at the bottom so as to straddle the bottom terminal of the slot. Upon installation of the bracket in the support, the curved rear portion of the head between the ear portion and the notch is jammed against the interior of the wall at a position diametrically opposite the slot to prevent the bracket from being swung upwardly. The depth of the notch and the length of the ear portion are configured such that the distance between a shoulder at the ear portion and the bottom of the notch is less than the length of the slot.

Again, however, this bracket is not designed for maximum flexibility in that the depth of the curved portion must be equal to or slightly greater than the depth of the support (that is, the back of the tab must rest against the back of the support wall, in order to achieve sufficient stability of the bracket supported by the support wall), and the short upper vertical surface does not permit the use of the bracket with varying slot sizes.

While the foregoing type of shelving system might be acceptable for home use where only one particular type of fixturing system is likely to be used, it is a drawback for commercial display organizations which are confronted with a wide variety of fixturing standards as previously mentioned. Thus, up to now, a firm which has used a particular type of adapter made by one manufacturer has been forced to purchase the other system components, e.g., gondolas comprising bases and shelving, from that manufacturer, notwithstanding that certain adapters are intended to make a display system more flexible but only within a particular manufacturer's design plan.

Another form of so-called "universal" shelving is shown in U.S. Pat. No. 4,575,164 in which a relatively thin gauge blank is formed with a mounting tab to allow the shelves of a service cart to be adjusted up or down to provide universality insofar as the distance between the shelves are concerned. To this end, the mounting tab is formed as an elongated body having a leading edge or nose and a trailing edge which allows manual repositioning of the slider. However, due to the length of the mounting tab, the sliders can only be used on uprights whose slot dimensions and depth are sufficient to accommodate the mounting tab. Such a tab would not be useful in different shelving systems, with gondolas and bases having different slot sizes.

SUMMARY OF THE INVENTION

It is an object of the present invention to provide a member, to be mounted on a slotted support (e.g., a vertical or substantially vertical slotted support) by inserting a mounting tab within slots of the support, wherein the member can be used with a plurality of different supports having different slot lengths and/or support wall thicknesses and/or distances between slots and/or depth between the front and rear walls of the support; to provide a system including the support and member; and to provide a method of erecting a system including the mounting support and member.

It is a specific object of the present invention to avoid the problems and limitations encountered in the prior art in which a shelf is supported by a bracket in a slotted standard or pole.

It is a still further object of the present invention to provide a shelf bracket which is capable of being used with the slotted standards or poles of most manufacturers, thus reducing the costs of shelving for the display of products, and a method which uses that bracket to erect a shelving system with almost any mounting pole.

It is another object of the present invention to provide a shelf bracket having a single notched tab and dimensioned such that the bracket can be used universally, i.e., on over 90%, on a wide variety of slotted standards or poles by the provision of a single tab with a notch at the bottom of the tab.

It is yet another object of the present invention to provide a bracket with a flange to support a shelf such that the shelf can be moved on the bracket to accommodate a variety of sizes of shelves for attachment to the bracket.

It is yet another object of the present invention to provide a bracket for supporting a shelf on a substantially vertical slotted support, whereby the shelf can be substantially perpendicular to the support or at an angle greater than 90° or less than 90° to the support.

It is yet another object of the present invention to provide a bracket for holding a shelf on a support (e.g., a substantially vertical support), wherein the shelf can be positioned on the bracket at various positions at different spacings from the support.

It is yet another object of the present invention to provide a bracket, for holding a shelf, having flexibility for use on different mounting supports, which mounting supports have different wall thicknesses, and/or different slot dimensions (length and/or width), and/or different depths between the front and rear walls of the mounting support, and/or different distances between slots.

In the following description, the present invention will be discussed in terms of its use in a shelving system including a substantially vertical mounting support, and a bracket mounted on the mounting support and supporting a shelf. However, as can be appreciated, the present invention is not so limited. Thus, the present invention can be used, generally, to mount any member on slotted supports (e.g., substantially vertical slotted supports). Various uses of the present invention, apart from shelving systems, can be appreciated (including, e.g., as a support, on a slotted pole or standard, to hold items for display).

The foregoing objects have been achieved by the provision of a bracket or adapter with a single tab of about 1⅜ inches in length, the tab to abut against the inner face of the support, the tab having a rearward surface (e.g., a curved rearward surface), the main body of the bracket having a relatively long downwardly extending rearward face to abut against the front face of the support. The bracket also has a 3/16 inch notched portion defined between the tab and the rearward face of the adapter, abutting against the support. The upper surface of the main body of the adapter or bracket is constituted by a flanged portion bent or formed at 90° to the face of the adapter. The flange is provided with two or more oblong openings or slots about ¾ inch long and 5/16 inch wide so that a shelf can be moved on the bracket flange while still being securely fastened to the bracket by screws and the like.

The rearward surface of the tab, desirably, has two portions, a first, upper portion (e.g., extending to the surface of the tab abutting the inner wall of the support) which facilitates entry of the tab into smaller slots (slots of relatively small length), and a second, lower portion (e.g., extending to the notch), of a different configuration than the first, upper portion, to permit proper positioning of the tab into a mounting pole slot of relatively shallow depth (e.g., relatively small distance between the slotted wall of the support and the rear of the support). Illustratively, but not limiting, the rearward surface on the tab can be curved.

The curved rearward surface on the tab could comprise a lower curved portion having a relatively small radius of curvature to facilitate proper positioning of the tab into slots in supports having relatively shallow depths and an upper curved portion having a relatively large radius of curvature to permit easy initial entry of the tab into a mounting pole slot of relatively small length. Of course, the upper and lower portions of the rearward surface of the tab need not be curved with radii of curvature as discussed in the foregoing (e.g., can be at least in part flat), as long as the rearward surface of the tab has two portions achieving the function discussed above.

The top portion of the upper curved surface can be flattened. Moreover, preferably a vertical surface extending downwardly from the flattened top portion to the joint portion between the tab and the main body of the bracket is orientated such that an imaginary line extending downwardly from that vertical surface will be intermediate the walls of the notch defined by the lower end of the tab and the main body.

Preferably, the side walls of the notch diverge from each other in a direction from the deepest portion of the notch (e.g., the base of the notch) to the opening thereof. For example, the wall forming the side of the notch adjacent the main body of the bracket, when positioned on a substantially vertical support member, can be substantially vertical and the opposite side wall of the notch diverge therefrom in the direction from the base of the notch to the opening. By having the side walls of the notch diverge in the direction toward the notch opening from the base of the notch, the notch can accept greater wall thicknesses of the support, while still being able to stably hold a support with relatively narrow wall thicknesses, thereby further increasing the flexibility of the bracket in use with various different supports of different manufacturers, where the supports have different wall thicknesses.

The rearward surface of the tab of the bracket according to the present invention need not be wedged against the rear wall of the mounting support, in order to stably mount the bracket on the support so that the bracket can hold a shelf and items thereon, as is required in U.S. Pat. No. 2,477,735. To the contrary, because the rearward surface of the tab can be spaced from the rear wall of the support, in the present invention, while still achieving sufficient stability, the bracket of the present invention can be used with various supports having differing distances between the front and rear (e.g., front and rear walls) of the mounting support, whereby flexibility of the bracket in use with different mounting supports is increased.

Stability according to the present invention is achieved by the front wall of the mounting support (at a slot) fitting in the notch defined by (a) the lower end of the single tab and (b) the main body of the bracket, in combination with (1) the front upper surface of the tab abutting against the inner surface of the front wall of the mounting support, and (2) the elongated lower rearward surface of the main body of the bracket abutting against the outer surface of the front wall of the mounting support, without more. In particular, by sufficiently elongating the lower rearward surface of the main body of the bracket to abut against the outer surface of the front wall of the mounting support, in combination with the aforementioned tab and notch, sufficient stability is achieved.

The bracket according to the present invention can be configured such that it can extend either orthogonally to the standard or pole or at an angle to the standard or pole depending upon the particular requirements of the user and the type of display desired. Such an angle can be greater than 90°, or less than 90°. However, regardless of the orientation of the bracket to the pole, the principles of the present invention will produce the same result as long as the rearward portion of the adapter or bracket is provided with a tab as hereinafter defined in relation to the rear surface of the adapter which abuts against the outer surface of the standard or pole.

BRIEF DESCRIPTION OF THE DRAWINGS

These and further features, objects and advantages of the present invention will become more apparent from the following detailed description when taken in conjunction with the accompanying drawings which show a presently preferred embodiment of the present invention and wherein.

DETAILED DESCRIPTION OF A PRESENTLY PREFERRED EMBODIMENT

Figure 1:
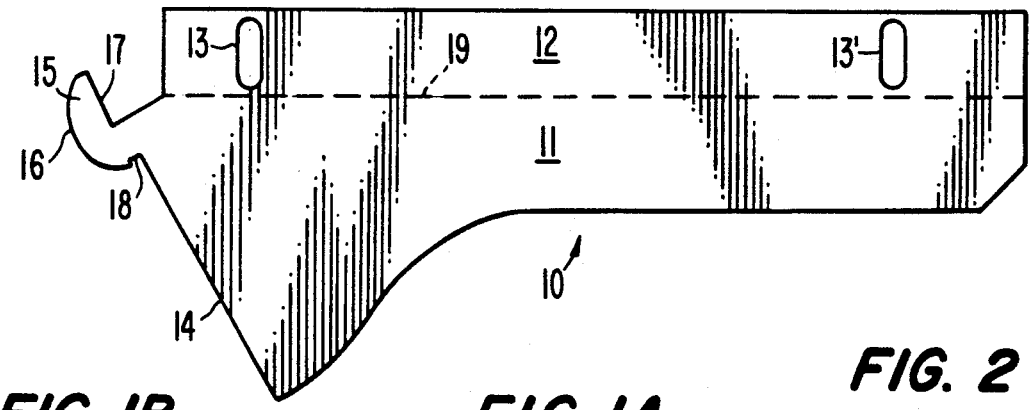
FIG. 1 is a side elevational view of the bracket in accordance with the present invention.

Referring now to the drawings, there is shown a shelf bracket of the type which extends at an angle (less than 90°) to the standard or pole so that the contents toward the rear of the shelf can be more readily observed. As can be appreciated, the shelf bracket can extend orthogonally to the standard or pole, or at an angle greater than 90° (e.g., where goods to be displayed on a shelf have a relatively large vertical dimension, and it is desired to ensure that the goods are retained on the shelf).

The bracket or adapter is designated generally by the numeral 10 and consists of a main body portion 11 which can be cut or stamped from a stiff but relatively thin material having sufficient strength and characteristics to support shelving and items placed on the shelving. A flange portion 12 of about ½ inch width can be formed integrally at the top of the body and subsequently folded over at 90° to the body 11 so as to form a flat support surface for a shelf. The flange portion 12 is provided with elongated slots 13, 13' with a length of ¾ inch and a width of 5/16 inch so that fastening means can securely hold a shelf to the adapter and furthermore to allow a variety of shelf lengths to be used without the need for precise positioning of the shelves relative to the bracket flange portion 12. Alternatively, a plurality of holes can be provided in the flange portion, along the length of the flange, in order to provide flexibility for positioning the shelf on the flange. For greater flexibility in positioning of the shelves, a plurality of elongated slots can be provided in the flange portion, along the length thereof, to achieve benefits of both the elongated slots and plurality of holes.

Rather than slots in the flange member, to hold the shelf on the bracket, as shown in the embodiment of FIG. 1, the main body of the bracket can have notched portions, e.g., at the back of the bracket (closest to mounting support 25), with the shelf having corresponding projecting portions to fit within the notched portions to stably hold the shelf on the bracket.

The previously disclosed techniques for holding the shelf on the bracket are merely illustrative and not limiting, and any known technique for supporting the shelf by the bracket (e.g., a bracket having hooks for holding a shelf, the shelf having structure so that the hooks stably hold the shelf during use) can be used according to the present invention.

The rear portion of the main body 11 which is about 3 ⅝ inches in width has a long rearward face 14 of 3¼ inches for abutment against the outer face of the wall of a standard or pole used in the shelving system. The front portion of the main body 11 has a width, exclusive of the flange 12, of about 1½ inches in the illustrated embodiment.

At the upper end of the rearward face 14 just referred to, there is provided a tab portion 15 having a length A of about 1¼ inches. The tab 15 has a rearward curved edge 16 and a forward vertical edge 17 which is designed to abut against the inside face of the wall of the standard or pole above a slot into which the tab portion 15 is inserted. By providing the tab having vertical edge 17 as shown in FIG. 1A, the bracket can be used with slot lengths of, e.g., ½ inch to 1¾ inch, covering over 90% of the slotted supports commercially utilized. A notch 18 of 3/16 inch width is defined at the lower end of the tab between the tab and the rearward surface of the main body 11 to accommodate most wall thicknesses of commercially available standards or poles.

Figure 1B:
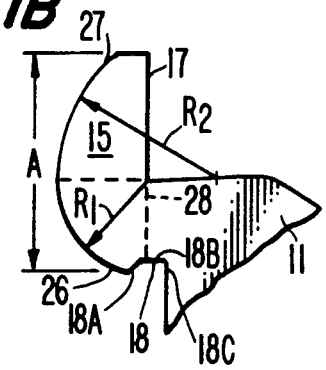
FIG. 1B shows a second embodiment for the tab and notch, the notch differing from that shown in FIG. 1A.
Figure 1A:
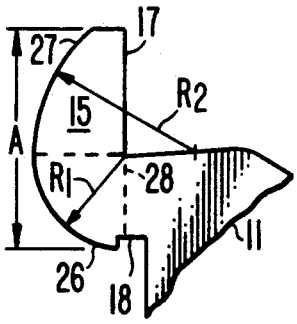
FIG. 1A is an isolated view of the tab and notch shown on the bracket of FIG. 1.

FIG. 1B shows a second embodiment of the notch according to the present invention. In this embodiment, side wall 18A of notch 18 diverges from the opposite side 18C of the notch, in the direction from the bottom 18B of the notch toward the opening. Due to the side wall 18A diverging from side wall 18C, so that the opening of the notch 18 is wider than the notch bottom 18B, a greater range of wall thickness of support 25 can be stably inserted within the notch, thereby increasing the variety of standards or poles with which the bracket of the present invention can be used, increasing the flexibility of the bracket.

The curved edge 16 of the tab 15 is a composite curve as shown in FIG. 1A. The composite curve consists of a curve 26 of relatively small radius of curvature $R_1$ in the lower quadrant and a curve 27 of relatively large radius of curvature $R_2$ in the upper quadrant. The upper curve 27 thus provides for easier entry of the tab 15 into slots of relatively short length whereas the lower curve 26 permits the tab to be inserted into slots of relatively shallow depth. The upper curve 27 can be flattened at its upper portion adjacent the vertical edge 17 to eliminate a sharp point which can damage persons and property and to strengthen the corner.

Figure 3:
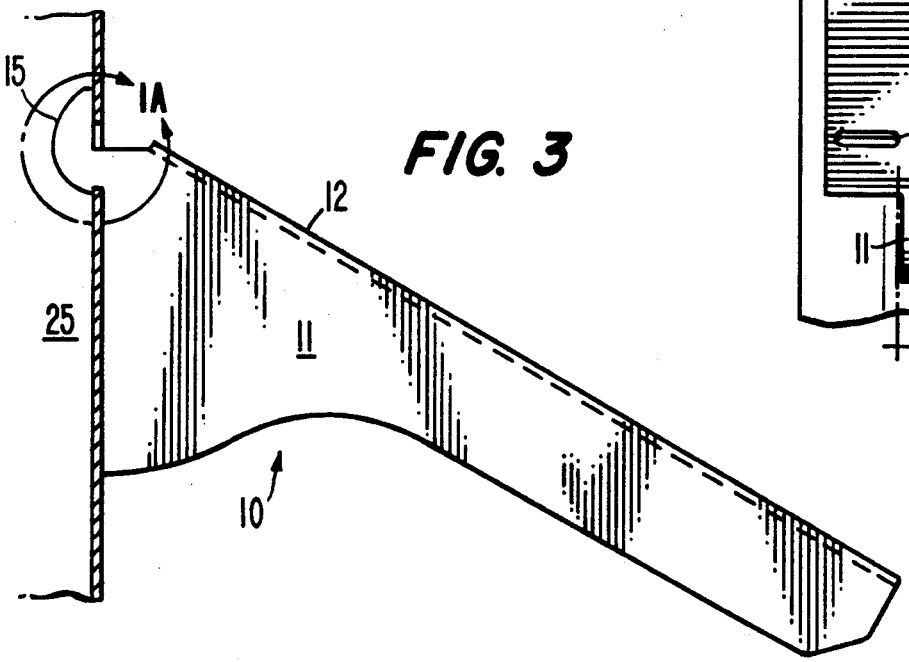
FIG. 3 is a fragmentary view of the bracket of FIG. 1 installed on a standard or pole.
Figure 4A:
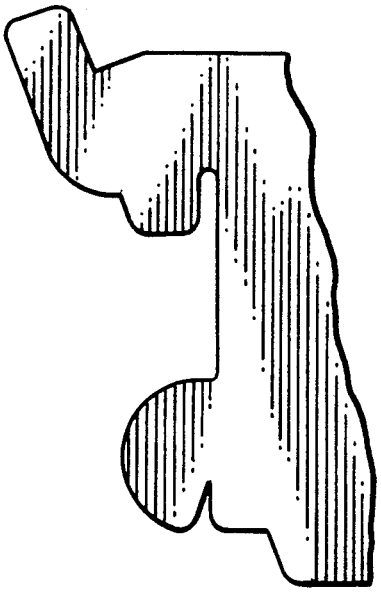
FIG. 4A (PRIOR ART)
FIGS. 4A–4E are partial side elevational views of conventional brackets.
Figure 4B:
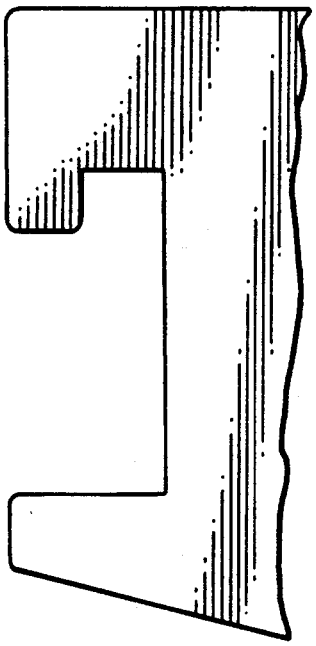
FIG. 4B (PRIOR ART)
Figure 4C:
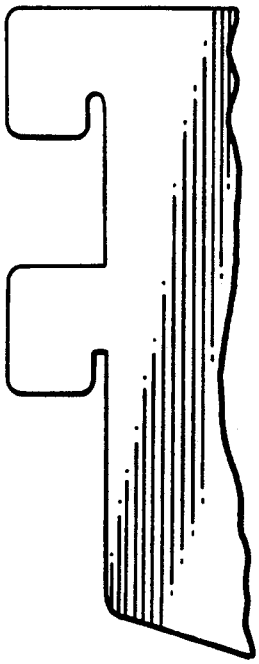
FIG. 4C (PRIOR ART)
Figure 4D:
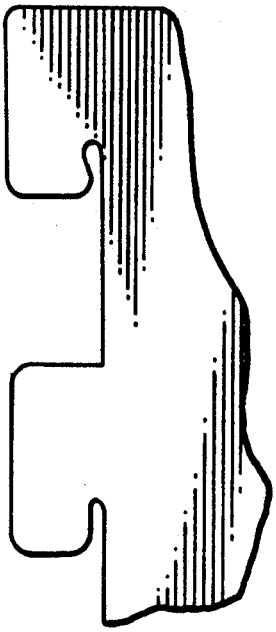
FIG. 4D (PRIOR ART)
Figure 4E:
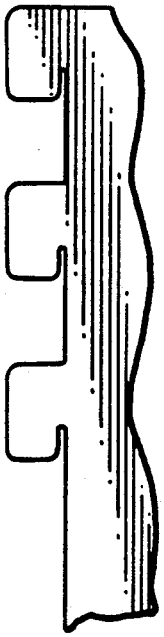
FIG. 4E (PRIOR ART)

The vertical edge 17 can be orientated such that an imaginary line 28 extended downward falls intermediate the side walls of the notch. This relationship further permits the bracket to be usable with most commercially available mounting supports since the wide slot can accommodate a variety of wall thicknesses while, at the same time, the vertical surfaces 14, 17 remain substantially flush with the outer and inner faces, respectively, of the support 25 (FIG. 3). While not shown in FIG. 3, the rearward surface of tab 15 need not be jammed against the back of support 25, in order to be stably held in the slot (e.g., the rearward surface of tab 15 can be spaced from the back of the slotted support, according to the present invention), as is necessary in the structure of U.S. Pat. No. 2,477,735. Thus, the bracket according to the present invention has increased flexibility in us with supports having various distances (depths) between the front wall of the support (that is, the wall supporting the bracket, 25A in FIG. 3) and the rear boundary (e.g., rear wall) of the support.

Figure 2:
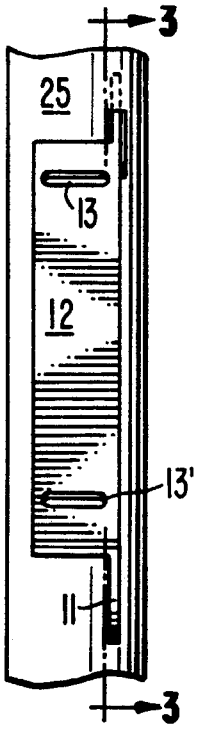
FIG. 2 is an end view of the bracket shown in FIG. 1 but with the flange formed at 90° to the body.

The upper surface 19 of the main body 11 can form a 30° angle with respect to a horizontal line extending orthogonally to the pole or standard 25 (FIG. 2). Alternatively, the main body can extend at 90° to the standard or pole, or can extend in a direction slanting upward relative to the horizontal line, without departing from the concept of the present invention.

The foregoing bracket or adapter fits a great majority, 90% or more, of fixturing systems presently available in the industry and thus eliminates the need to inventory many different types of adapters and other gondola components. Such an approach results in substantial cost savings to the display industry.

While I have shown and described an embodiment in accordance with my invention, it is to be understood that the same is susceptible of numerous changes and modification as will be apparent to one of ordinary skill in the art. Therefore, I do not intend to be limited to the details shown and described herein but intend to cover all such changes and modifications as are encompassed by the scope of the appended claims.

I claim:

1. A member, adapted to be mounted on a mounting support that has slots spaced therealong, comprising a main body portion, and a single tab extending from the main body portion so as to form a notch between the main body portion and a bottom portion of the tab for engaging a lower end of a mounting support slot, the main body portion including a downwardly extending lower rearward surface dimensioned to abut against an outer face of a front wall of the mounting support below the lower end of the slot, the downwardly extending lower rearward surface extending lower than the bottom portion of the tab, the tab having an upwardly extending surface for engaging an inner face of the front wall of the mounting support above an upper end of the mounting support slot, the downwardly extending lower rearward surface being sufficiently elongated lower than the bottom portion of the tab such that the notch, in combination with the upwardly extending surface of the tab and the downwardly extending lower rearward surface, provides sufficient stability for the member mounted on the mounting support without the tab being wedged against a rear surface of the mounting support opposite a mounting support wall having the slots therein.

2. A member according to claim 1, wherein the member is a bracket adapted for use in a shelving system, the downwardly extending lower rearward surface of the main body portion being sufficiently elongated such that the notch, in combination with the upwardly extending surface of the tab and the downwardly extending lower rearward surface, provides stability for the bracket mounted on the mounting support and having a shelf thereon and items on the shelf.

3. A bracket according to claim 2, wherein the tab has a curved rearward surface extending between the notch and the upwardly extending surface of the tab.

4. A bracket according to claim 2, wherein the tab has a rearward surface opposite to the upwardly extending surface, the rearward surface extending between the notch and the upwardly extending surface of the tab, the rearward surface of the tab having two portions, (1) a first, upper portion closer to the upwardly extending surface of the tab and configured to permit initial entry of the tab into smaller slots, and (2) a second, lower portion closer to the notch and configured different from the first, upper portion, to permit proper positioning of the tab into a mounting support of shallow depth.

5. A bracket according to claim 4, wherein the rearward surface of the tab has a curved surface, and wherein said second, lower portion has a first radius of curvature and the first, upper portion has a second radius of curvature larger than the first radius of curvature.

6. A bracket according to claim 4, wherein an imaginary line extending downwardly along the upwardly extending surface of the tab extends between side walls of the notch.

7. A bracket according to claim 6, wherein the notch is bounded by said side walls and a base, and has an opening opposite the base for entry into the notch, and wherein the side walls diverge from each other in a direction from the base to the opening.

8. A bracket according to claim 7, wherein one of the side walls of the notch is constituted by the downwardly extending lower rearward surface of the main body portion.

9. A bracket according to claim 4, wherein the notch is bounded by side walls and a base, and has an opening opposite the base for entry into the notch, and wherein the side walls diverge from each other in a direction from the base to the opening.

10. A bracket according to claim 9, wherein one of the side walls of the notch is constituted by the downwardly extending lower rearward surface of the main body portion.

11. A bracket according to claim 2, wherein an imaginary line extending downwardly along the upwardly extending surface of the tab extends between side walls of the notch.

12. A bracket according to claim 11, wherein the notch is bounded by said side walls and a base, and has an opening opposite the base for entry into the notch, and wherein the side walls diverge from each other in a direction from the base to the opening.

13. A bracket according to claim 12, wherein one of the side walls of the notch is constituted by the downwardly extending lower rearward surface of the main body portion.

14. A bracket according to claim 2, wherein the notch is bounded by side walls and a base, and has an opening opposite the base for entry into the notch, and wherein the side walls diverge from each other in a direction from the base to the opening.

15. A bracket according to claim 14, wherein one of the side walls of the notch is constituted by the downwardly extending lower rearward surface of the main body portion.

16. A bracket according to claim 2, wherein an upper portion of the tab, adjacent the upwardly extending surface of the tab, is flattened.

17. A bracket according to claim 2, further comprising a flange associated with the main body portion, for supporting a shelf.

18. A bracket according to claim 17, wherein the flange has apertures therethrough for fastening the shelf to the flange.

19. A bracket according to claim 18, wherein the apertures are at least two spaced-apart slots.

20. A bracket according to claim 18, wherein the apertures are a plurality of holes spaced along a length of the flange in a direction out from the mounting support.

21. A member according to claim 1, wherein the tab has a tab rearward surface extending between the notch and the upwardly extending surface of the tab, and wherein a width of the tab, in a direction from the main body portion to the tab rearward surface, is sufficiently small such that when the member is mounted on the mounting support, the tab rearward surface does not contact the rear surface of the mounting support.

22. A method according to claim 21, wherein said different slot sizes is at least one of different wall thicknesses of the mounting supports at the slots, different slot dimensions, different distances between slots, and different depths between a front wall of the mounting support having the slots therein and a rear surface of the mounting support opposite to the front wall.

23. A member, adapted to be mounted on a mounting support that has slots spaced therealong, comprising a main body portion and a single tab extending from the main body portion so as to form a notch between the main body portion and a bottom portion of the tab for engaging a lower end of a mounting support slot, the main body portion including a downwardly extending lower rearward surface dimensioned to abut against an outer face of a front wall of the mounting support below the lower end of the slot, the downwardly extending lower rearward surface extending lower than the bottom portion of the tab, the tab having an upwardly extending surface for engaging an inner face of the front wall of the mounting support above an upper end of the mounting support slot, wherein the tab has a rearward surface opposite to the upwardly extending surface, extending between the notch and the upwardly extending surface of the tab, the rearward surface of the tab having two portions, (1) a first, upper portion closer to the upwardly extending surface of the tab and configured to permit initial entry of the tab into smaller slots, and (2) a second, lower portion closer to the notch and configured different from the first, upper portion, to permit proper positioning of the tab into a mounting support of shallow depth.

24. A member according to claim 23, wherein the rearward surface of the tab has a curved surface, and wherein said second, lower portion has a first radius of curvature and the first, upper portion has a second radius of curvature larger than the first radius of curvature.

25. A member, adapted to be mounted on a mounting support that has slots spaced therealong, comprising a main body portion, and a single tab extending from the main body portion so as to form a notch between the main body portion and a bottom portion of the tab for engaging a lower end of a mounting support slot, the main body portion including a downwardly extending lower rearward surface dimensioned to abut against an outer face of a front wall of the mounting support below the lower end of the slot the downwardly extending lower rearward surface extending lower than the bottom portion of the tab, the tab having an upwardly extending surface for engaging an inner face of the front wall of the mounting support above an upper end of the mounting support slot, wherein an imaginary line extending downwardly along the upwardly extending surface of the tab extends between side walls of the notch.

26. A member and mounting support arrangement, comprising a mounting support having at least one slot extending from an outer face of a front wall of the support to an inner face of the front wall such that the slot defines an upper and a lower end having a wall thickness defined by the inner and outer faces, and a member operatively associable with the slot of the support, wherein the member comprises a main body portion and a single tab extending from the main body portion so as to form a notch between the main body portion and a bottom portion of the tab, the main body portion having a downwardly extending lower rearward surface dimensioned to abut against the outer face of the front wall below the lower end of the slot and extending lower than the bottom portion of the tab, the tab having an upwardly extending surface for engaging the inner face of the front wall above an upper end of the slot and having a rearward surface extending from the notch to the upwardly extending surface, wherein the rearward surface of the tab does not contact a rear surface of the mounting arrangement, opposite the front wall, when the member is mounted on the mounting support.

27. An arrangement according to claim 26, wherein said member is a bracket, adapted to support a shelf.

28. A method of building an arrangement utilizing (1) any one of different varieties of mounting supports respectively having different slot sizes, together with (2) members for mounting on the mounting supports, comprising the steps of:

selecting one of the different varieties of mounting supports having different slot sizes, and erecting the selected variety of mounting support;

selecting a plurality of members configured to fit all of the different varieties of mounting supports having different slot sizes; and form-lockingly installing the plurality of members in the erected mounting supports.

29. A method according to claim 28, wherein said member is a bracket, adapted to support a shelf, the method being a method of building a shelving system.

* * * * *